US006171139B1

(12) United States Patent
Sato et al.

(10) Patent No.: US 6,171,139 B1
(45) Date of Patent: Jan. 9, 2001

(54) RIGHT-ANGLE CONNECTOR UNIT HAVING SIGNAL PASSES EQUAL TO ONE ANOTHER IN LENGTH

(75) Inventors: Kazuomi Sato, Tokorozawa; Masahiro Yamauchi, Tokyo, both of (JP)

(73) Assignee: Japan Aviation Electronics Industry, Limited, Tokyo (JP)

( * ) Notice: Under 35 U.S.C. 154(b), the term of this patent shall be extended for 0 days.

(21) Appl. No.: 09/252,442

(22) Filed: Feb. 18, 1999

(30) Foreign Application Priority Data

Feb. 19, 1998 (JP) ..... 10-037577

(51) Int. Cl.[7] ..... H01R 11/00
(52) U.S. Cl. ..... 439/502
(58) Field of Search ..... 439/502, 623

(56) References Cited

U.S. PATENT DOCUMENTS

| | | | | |
|---|---|---|---|---|
| 3,963,300 | * | 6/1976 | Patton et al. | 439/638 |
| 4,954,100 | * | 9/1990 | McCleerey | 439/502 |
| 4,954,101 | * | 9/1990 | Nelson | 439/502 |
| 5,433,631 | | 7/1995 | Beaman et al. . | |
| 5,557,075 | | 9/1996 | Nugent . | |

FOREIGN PATENT DOCUMENTS

| | | |
|---|---|---|
| 0 583 097 | 2/1994 | (EP) . |
| 0 644 628 | 3/1995 | (EP) . |
| 0 752 739 | 1/1997 | (EP) ..... H01R/23/68 |

OTHER PUBLICATIONS

European Search Report dated May 6, 1999.

* cited by examiner

*Primary Examiner*—Khiem Nguyen
*Assistant Examiner*—Hae Moon Hyeon
(74) *Attorney, Agent, or Firm*—Laff, Whitesel & Saret, Ltd.; J. Warren Whitesel

(57) ABSTRACT

A right-angle connector unit used for electrical and removable connection between first and second printed circuit boards (600, 700), which comprises two right-angle connectors (100, 200) of printed circuit boards having base portions to be mounted to the first and the second printed circuit boards, vertical portions, and contacts of conductor patterns extending in parallel with each other between the base portions and the vertical portions and having different lengths, and a cable connector (400) having a flexible flat cable connecting between the vertical portions of the two right-angle connectors in a state where the flexible flat cable is twisted by an angle of 180 degree along a longitudinal direction thereof, the flexible flat cable having conductors which are equal to each other in length. A plurality of signal passes established between first and second printed circuit boards by contacts of the two right-angle connectors and the conductors of the flat cable connectors are equal to each other in length. The cable connector may comprise a bundle of discrete cables, a flexible printed cable, a bundle of coaxial cables, or a bundle of drained coaxial cable instead of the flexible flat cable.

15 Claims, 12 Drawing Sheets

RIGHT-ANGLE CONNECTOR UNIT HAVING SIGNAL PASSES EQUAL TO ONE ANOTHER IN LENGTH

BACKGROUND OF THE INVENTION

The present invention relates to a right-angle connector unit for electrical and removable connection between first and second electric devices, which comprises a first right-angle connector connected to the first electric device, a second right-angle connector connected to the second electric device, and a cable connector having flexibility and removably connecting between the first and the second right-angle connectors.

In a conventional right-angle connector unit of the type described above, the first and the second right-angle connectors comprise a first and a second circuit board, respectively, which will be referred to as a first and a second connector boards, respectively. The first and the second electric devices usually comprise circuit boards, respectively, which will be referred to as a first mother board and a second mother board so as to distinguish them from the first and the second connector boards. The cable connector usually comprises a flexible flat cable or a flexible printed cable.

The first connector board comprises a first base portion or side to be mounted on and face a surface of the first mother board as a connection part of the first electric device, a first vertical portion or side extending substantially in perpendicular to the first base portion, and first through n-th (in which n is an integer but not smaller than 2) conductor strips as primary contacts extending thereon in parallel to one another between the first base portion and the first vertical portion. Herein, the first through the n-th primary contacts have one ends which are arranged in a first direction along the first base portion with spaces left between adjacent ones and are formed into, usually, pin terminals to be connected to the first mother board. The other ends of the first through the n-th primary contacts are also arranged in a direction perpendicular to the first direction along the first vertical portion with spaces left between adjacent ones and are also formed into, usually, pin terminals to be connected to one end of the cable connector. Therefore, it is noted that one of the first and n-th primary contacts relatively near to a corner where the first base and vertical portions intersect is shorter in length than another primary contact relatively remote from the corner, that is, i-th primary contact, i being smaller than n but larger than 1, is longer than an (i−1)-th primary contact.

Likewise, the second connector boards as the second right-angle connector comprises a second base portion to be mounted on the second mother board, a second vertical portion perpendicular to the second base portion, and first through n-th secondary contacts extending thereon in parallel to one another between the second base portion and the second vertical portion. Herein, the first through the n-th secondary contacts have one ends which are arranged in a second direction along the second base portion with spaces left between adjacent ones and are formed into, usually, pin terminals to be connected to the second mother board. The other ends of the first through the n-th secondary contacts are also arranged in a direction perpendicular to the second direction along the second vertical portion with spaces left between adjacent ones and are also formed into, usually, pin terminals to be connected to the other end of the cable connector. Therefore, it is noted that one of the first and n-th secondary contacts relatively near to a corner where the second base and vertical portions intersect is shorter in length than another secondary contact relatively remote from the corner, that is, i-th secondary contact, i being smaller than n but larger than 1, is longer than an (i−1)-th secondary contact.

The cable connector comprises first through n-th conductors equal to one another in length. The first through n-th conductors are provided with socket terminals at opposite ends which are mated with the pin terminals of the first through n-th primary and secondary contacts of the first and second connector boards, respectively. As a result, the first through the n-th conductors are removably connected to the first through the n-th primary contacts of the first right-angle connector and to the first through n-th secondary contacts of the second right-angle connector, respectively.

When the cable connector connects between the first and the second right-angle connectors, the first through the n-th primary contacts of the first right-angle connector and the first through the n-th secondary contacts of the second right-angle connector are connected to one another through the first through the n-th conductors of the cable connector, respectively, to thereby form a plurality of first through n-th signal passes for transmitting signal therethrough, respectively. The first through n-th signal passes are different to one another in length. This is because the i-th primary contact is longer than the (i−1)-th primary contact and the n-th secondary contact is longer than the (i−1)-th secondary contact, while the n-th primary contact and the (i−1)-th primary contact are connected to the i-th secondary contact and the (i−1)-th secondary contact through i-th conductor and (i−1)-th conductor to thereby form i-th signal pass and (i−1)-th signal pass, respectively. Therefore, signals transmitted through the signal passes are different to one another in delay or passage time.

Recently, the right-angle connector unit is requested to transmit high frequency signal at high speed when applied to such electric devices as circuit board provided with a large scale integrated semiconductor chips, a data storage device, and so on. However, the electric devices can not perform their functions at a desired high speed by signal transmission through the conventional right-angle connector unit because the signals transmitted through the signal passes are different to one another in delay time as described above.

In addition, the right-angle connector unit is required to increase a number of signal passes because the electric devices recently tend to have input/output signals increased. In the conventional right-angle connector unit, when the number of signal passes is increased, the numbers of the primary contacts and the secondary contacts are also increased. As a result, there is increased a difference in length between the shortest one (first) and longest one (n-th) of the primary or secondary contacts. Therefore, the largest difference in length among the signal passes is increased. This means that largest time delay is also increased.

SUMMARY OF THE INVENTION

It is therefore an object of the present invention to provide a right-angle connector unit can transmit signals so as to be equal to one another in delay time.

It is another object of the present invention to provide a right-angle connector unit comprising signal passes equal to one another in delay time.

The other objects, features, and advantages of the present invention will become clear as the following description proceeds.

The present invention is directed to a right-angle connector unit for electrical and removable connection between first and second electric devices. The right-angle connector unit comprises a first right-angle connector connected to the first electric device, a second right-angle connector connected to the second electric device, and a cable connector having flexibility and removably connecting between the first and the second right-angle connectors. The first right-angle connector comprises a first base portion facing a connection part of the first electric device, a first vertical portion extending substantially in perpendicular to the first base portion, and first through n-th primary contacts, n being an integer but not smaller than 2, extending in parallel to one another between the first base and the first vertical portions. The first through the n-th primary contacts have one ends and the other ends. The one ends of the first through the n-th primary contacts are arranged in a first primary direction along the first base portion with spaces left between adjacent ones and are formed to be connected to the connection part of the first electric device. The other ends of the first through the n-th primary contacts are arranged in a second primary direction perpendicular to the first primary direction along the first vertical portion with spaces left between adjacent ones and are formed to be connected to one end of the cable connector. An i-th primary contact, i being smaller than n but larger than 1, of the first through the n-th primary contacts are longer than an (i−1)-th primary contact. The second right-angle connector comprises a second base portion facing a connection part of the second electric device, a second vertical portion extending substantially in perpendicular to the second base portion, and first through n-th secondary contacts extending in parallel to one another between the second base and the second vertical portions. The first through the n-th secondary contacts have one and the other ends. The one ends of the first through the n-th secondary contacts are arranged in a first secondary direction along the second base portion with spaces left between adjacent ones and are formed to be connected to the connection part of the second electric device. The other ends of the first through the n-th secondary contacts are arranged in a second secondary direction perpendicular to the first secondary direction along the second vertical portion with spaces left between adjacent ones and are formed to be connected to one end of the cable connector. An i-th secondary contact of the first through the n-th secondary contacts is longer than an (i−1)-th secondary contact. The cable connector comprises first through n-th conductors equal to one another in length. The first through the n-th conductors connect the first through the n-th primary contacts of the first right-angle connector with the n-th through the first secondary contacts of the second right-angle connector, respectively.

DESCRIPTION OF THE PREFERRED EMBODIMENTS

Figure 1:
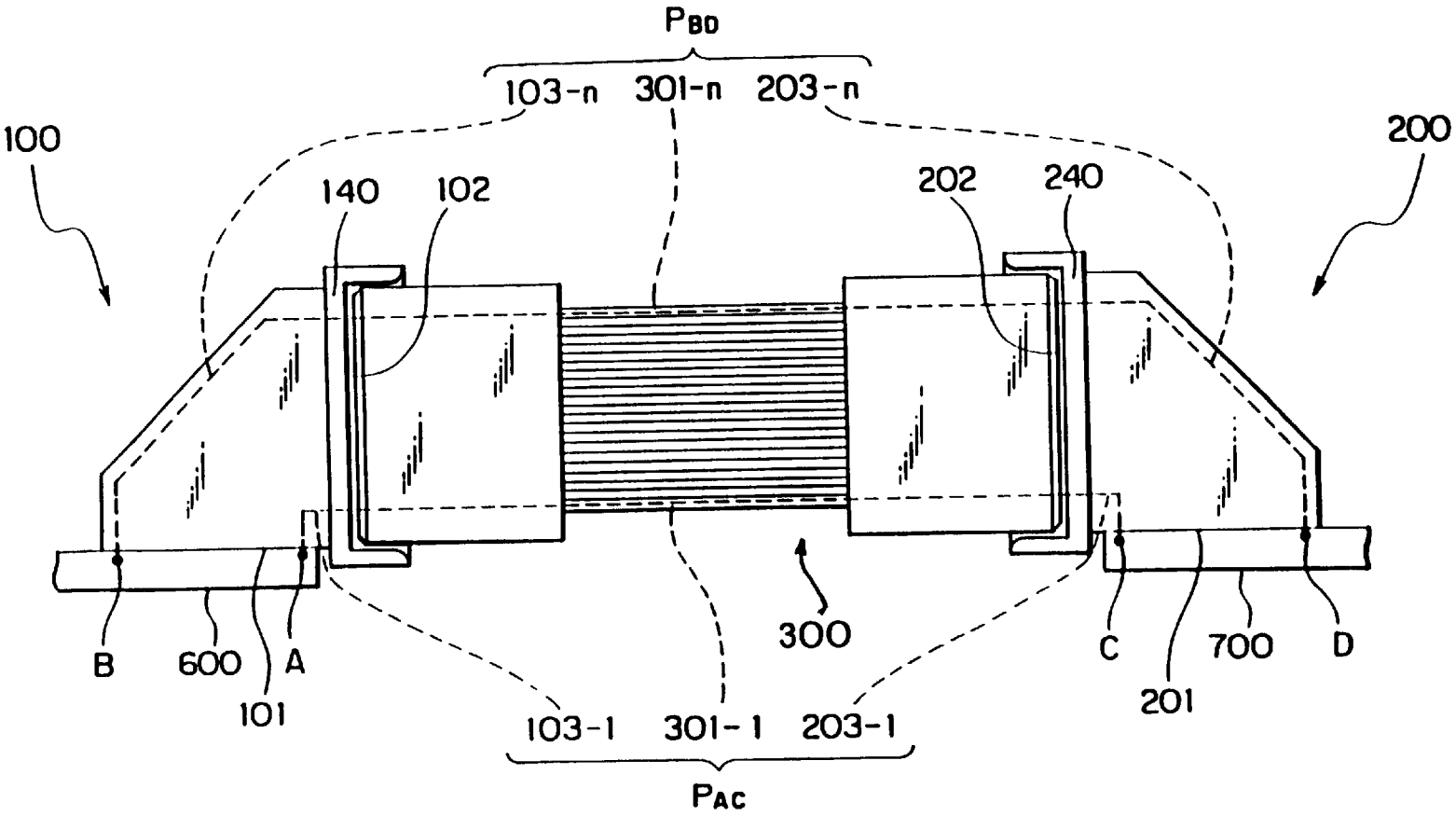
FIG. 1 PRIOR ART
FIG. 1 is a side view showing a conventional right-angle connector unit.

In order to facilitate an understanding of the present invention, description will at first be made with reference to the drawing about a conventional right-angle connector unit of a type described in the preamble of the present specification.

Referring to FIG. 1, the conventional right-angle connector unit is used for electrical and removable connection between first and second mother boards 600 and 700 as first and second electric devices. The right-angle connector unit comprises first right-angle connector 100 serving as the first right-angle connector connected to the mother board 600, second right-angle connector 200 serving as the second right-angle connector connected to the second mother board 600, and cable connector 300 comprising a flexible flat cable.

The first right-angle connector 100 comprises first base side or portion 101 to be mounted onto a surface of the first other board 600, first vertical side or portion 102 extending substantially in perpendicular to the first base portion 101, and primary contacts 103-1 to **103-*n* (in which an n is not smaller than 2) which are conductor strips extending on the first right-angle connector 100 in parallel to one another between the first base portion 101 and the first vertical portion 102**.

Herein, as shown in the figure, one of the primary contacts 103-1 to **103-*n* relatively near to a corner where the first base portion 101 and the first vertical portion 102 intersect is shorter in length than another of the primary contacts 103-1 to 103-*n* relatively remote from the corner. For example, primary contact 103-1 adjacent the corner is shortest while primary contact 103-*n* most remote from the corner is longest in n primary contacts 103-1 to 103-*n***.

Likewise, the second right-angle connector 200 comprises the second base portion or side 201 to be mounted on the second mother board 700, the second vertical portion or side 202 extending substantially in perpendicular to the second base portion 201, and secondary contacts 203-1 to **203-*n* which are conductor strips extending in parallel to one another between the second base portion 201 and the second vertical portion 202**.

Herein, as shown in the figure, one of the secondary contacts 203-1 to **203-*n* relatively near to a corner where the second base portion 201 and the second vertical portion 202 intersect is shorter in length than another of the secondary contacts 203-1 to 203-*n* relatively remote from the corner. For example, secondary contact 203-1 adjacent the corner is shortest while secondary contact 203-*n* most remote from the corner is longest in n secondary contacts 203-1 to 203-*n***.

The cable connector 300 of the flexible flat cable comprises conductors 301-1 to **301-*n*** having an equal length.

The conductors 301-1 to **301-*n* are removably connected the primary contacts 103-1 to 103-*n* of the first right-angle connector 100 and the secondary contacts 203-1 to 203-*n* of the second right-angle connector 200, respectively. Thus, n signal passes are established between the first and the second mother boards 600 and 700. For example, a signal pass $P_{BD}$ formed or connected between points B and D on the first and the second mother boards 600 and 700 is composed of the primary contact 103-*n*, conductor 301-*n* and secondary contact 203-*n*, while another signal pass $P_{AC}$ formed or connected between points A and C on the first and the second mother boards 600 and 700 is composed of primary contact 103-1, conductor 301-1 and secondary contact 203-1**. The signal pass $P_{BD}$ is far longer than the signal pass $P_{AC}$.

In FIG. 1, a first and a second holding insulator is shown at 140 and 240 so as to hold the first vertical portion 102 of the first right-angle connector 100 and the second vertical portion 202 of the second right-angle connector 200, respectively.

The conventional right-angle connector unit has problems described in the preamble.

Now, preferred embodiments of the present invention will be described with reference to FIGS. 2 to 12.

Figure 2:
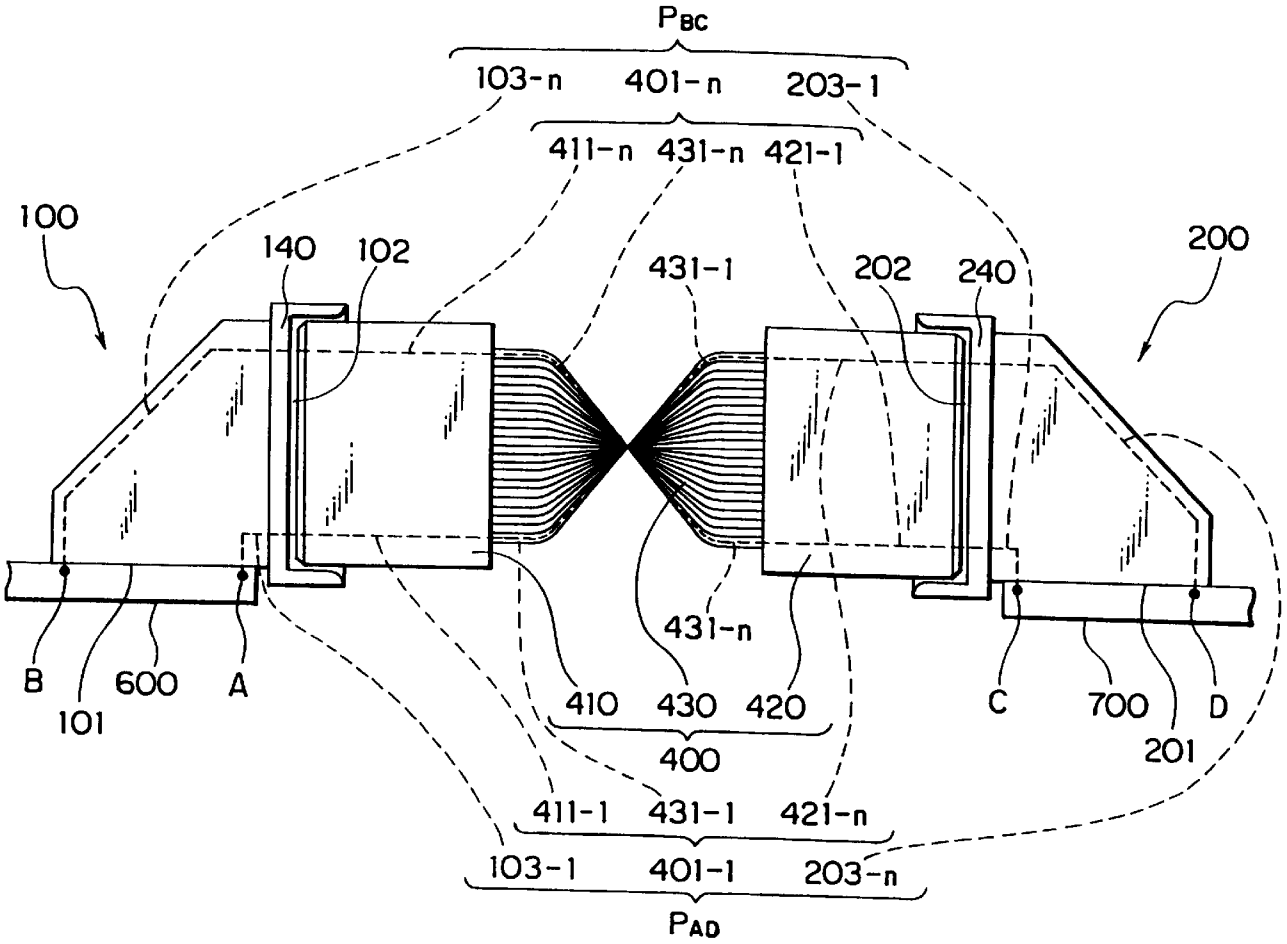
FIG. 2 is a side view showing a right-angle connector unit according to a first embodiment of the present invention.

Referring to FIG. 2, a right-angle connector unit according to a first embodiment of the present invention is shown as being used for electrical and removable connection between printed circuit boards 600 and 700. The right-angle connector unit of this embodiment has similar parts designated by the same reference numerals that are illustrated in FIG. 1, respectively. The similar parts are omitted in detailed description.

The cable connector 400 comprises conductors 401-1 to **401-*n* equal to one another in length. The cable connector 400 is twisted by an angle of 180 degree and is connected to the first and the second connector boards 100 and 200. Accordingly, the conductors 401-1 to 401-*n* are removably connected the primary contacts 103-1 to 103-*n* of the first right-angle connector 100 and the secondary contacts 203-*n* to 203-1 of the second right-angle connector 200, respectively, to thereby form a plurality of signal passes $P_{BC}$, $P_{AD}$ and so on for transmitting signal therethrough, respectively. The signal passes are equal to one another in length, although the primary contact 103-*n* is longer than the primary contact 103-1 and the secondary contact 203-*n* is longer than the secondary contact 203-1. This is because the primary contacts 103-1 to 103-*n* are connected to the secondary contacts 203-*n* to 203-1 through the conductors 401-1 to 401-*n*** to thereby form first through n-th signal passes, respectively. Therefore, signals transmitted through the signal passes are also equal to one another in delay or passage time.

For example, a signal pass $P_{BC}$ formed or connected between points B and C on the circuit boards 600 and 700 is equal to a signal pass $P_{AD}$ formed or connected between points A and D on the circuit boards 600 and 700. Therefore, signal transmitted through the signal pass $P_{BC}$ is also equal to a signal transmitted through the signal pass $P_{AD}$ in delay time.

The primary contacts 103-1 to **103-*n* of the first right-angle connector 100 and the secondary contacts 203-1 to 203-*n* of the second right-angle connector 200** are equal to each other in length, respectively.

Figure 3:
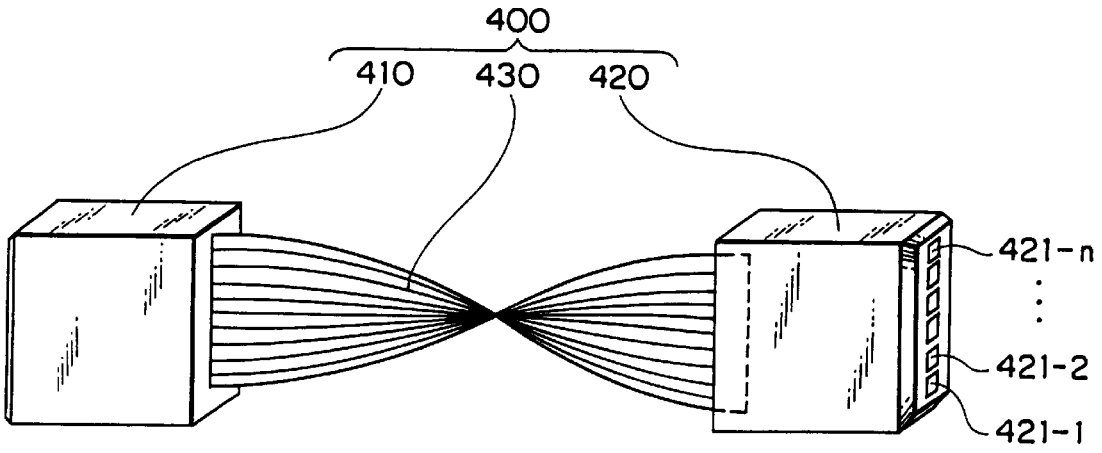
FIG. 3 is a perspective view showing a cable connector shown in FIG. 2.

Referring to FIGS. 2 and 3, the cable connector 400 comprises a connector 410 serving as a first connector removably connected to the first right-angle connector 100, a connector 420 serving as a second connector removably connected to the second right-angle connector 200, and a flexible flat cable 430 connected between the connectors 410 and 420.

The connectors 410 and 420 comprise socket terminals 411-1 to **411-*n* and 421-1 to 421-*n* serving as first through n-th contacts equal to one another in length, respectively. The cable 430 comprises wires 431-1 to 431-*n* serving as first through n-th wires equal to one another in length, respectively. The wires 431-1 to 431-*n* are connected the socket terminals 411-1 to 411-*n* of the connector 410 and the socket terminals 411-*n* to 421-1 of the connector 420, respectively. In other words, the cable 430 is twisted along a longitudinal direction thereof so that the wires 431-1 to 431-*n* placed at one end of the cable 430 and the wires 431-1 to 431-*n* placed at another end of the cable 430** are turned over each other, respectively.

The socket terminals 411-1 to **411-*n* of the connector 410, the wires 431-1 to 431-*n*, and the socket terminals 411-*n* to 421-1 of the connector 420 serve in cooperation with one another as the conductors 401-1 to 401-*n*,** respectively.

The cable connector 400 comprises a flat ribbon cable serving as the cable 430. The flat ribbon cable comprises an integument sleeve covering with the wires 431-1 to **431-*n*.**

Figure 4:
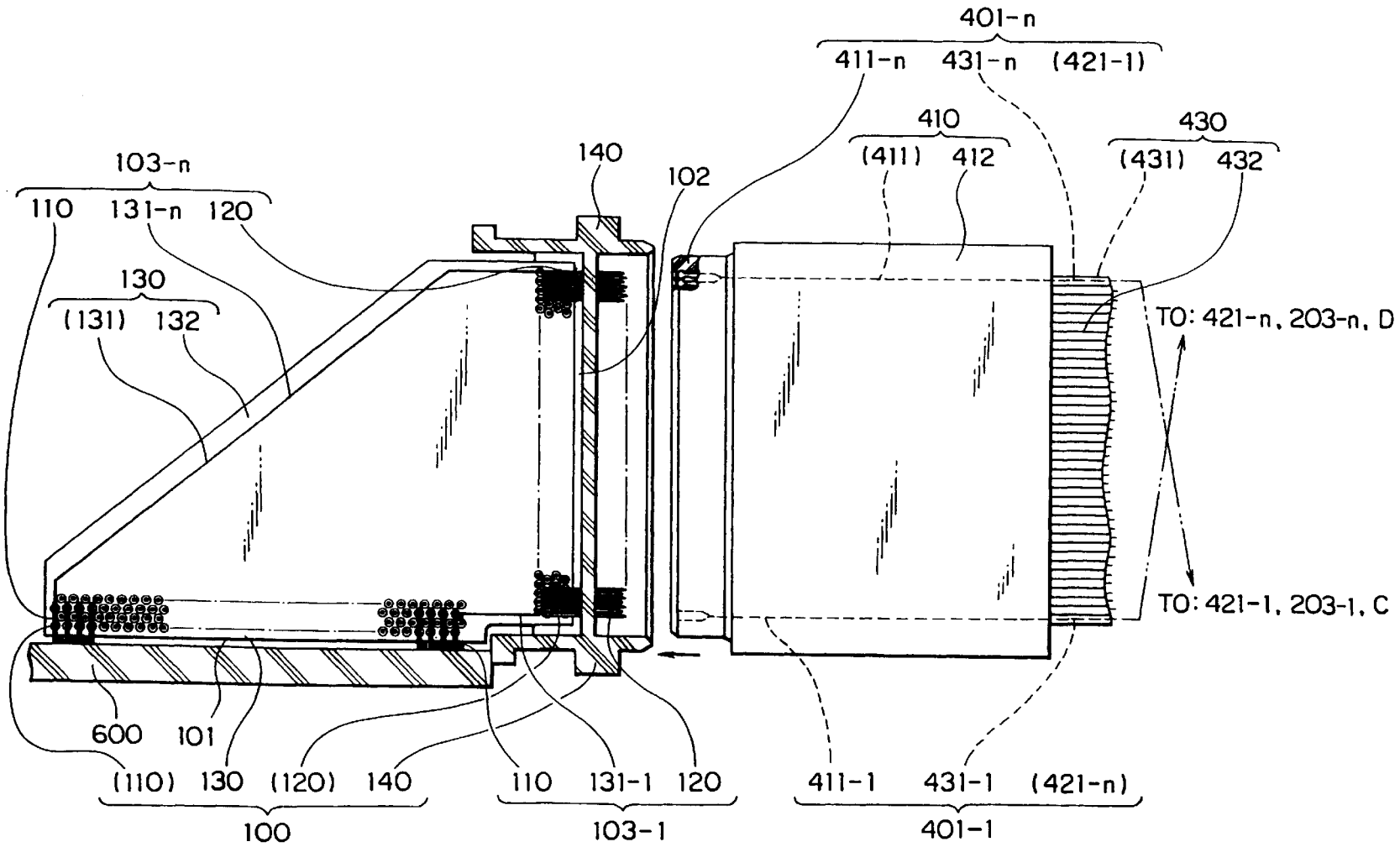
FIG. 4 is a side view but partially sectioned showing a part of the right-angle connector shown in FIG. 2.

Referring to FIG. 4, the first right-angle connector 100 comprises pin terminals (collectively shown by 110) serving as first terminals arranged in the first base portion, terminals (collectively shown by 120) serving as second terminals arranged in the first vertical portion, and print-patterns 131-1 to **131-*n* printed on a board 132 and respectively connected between the terminals 110 and 120. A first connector board 130 consists of the print-patterns 131-1 to 131-*n* and the board 132. The first connector board 130 is perpendicularly arranged on the connection part of the first mother board 600**.

Figure 6A:
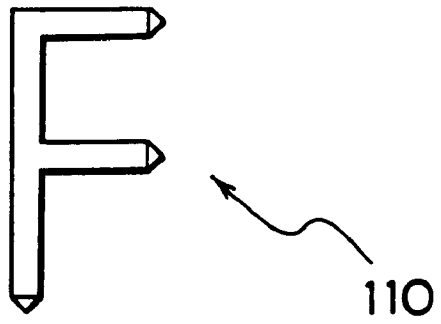
FIGS. 6A and 6B are side views showing terminals shown in FIG. 3, respectively.

Referring to FIG. 6A, the pin terminal 110 has an L-shape (or an F-shape) provided with first and second lines (or first line and double-second line) angled to each other so as to form a near right-angle therebetween. The first line is connected to the connection part of the first mother board 600. The second line (or the double-second line) is connected to one of the print-patterns 131-1 to **131-*n*.**

Figure 6B:
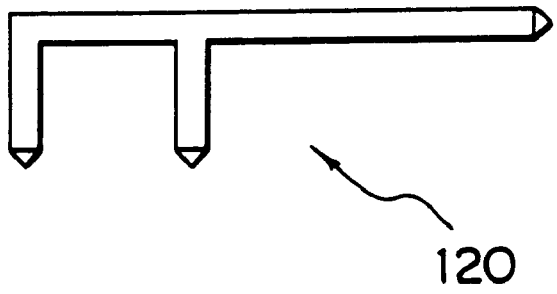

Referring to FIG. 6B, the pin terminal 120 has an L-shape (or an F-shape) provided with first and second lines (or first line and double-second line) angled to each other so as to form a near right-angle therebetween. The second line (or the double-second line) is connected to one of the print-patterns 131-1 to **131-*n*. The first line is removably connected to the cable connector 400**.

The terminals 110, the print-patterns 131-1 to **131-*n*, and the terminals 120 serve as primary contacts 103-1 to 103-*n*,** respectively.

Returning to FIG. 4, the first right-angle connector 100 further comprises the holding insulator 140 (which will simply be referred to "insulator" hereinafter) mounted at the first vertical portion. The first lines of the terminals 120 are mounted and arranged in the insulator 140 so as to be electrically insulated to on another.

Figure 5:
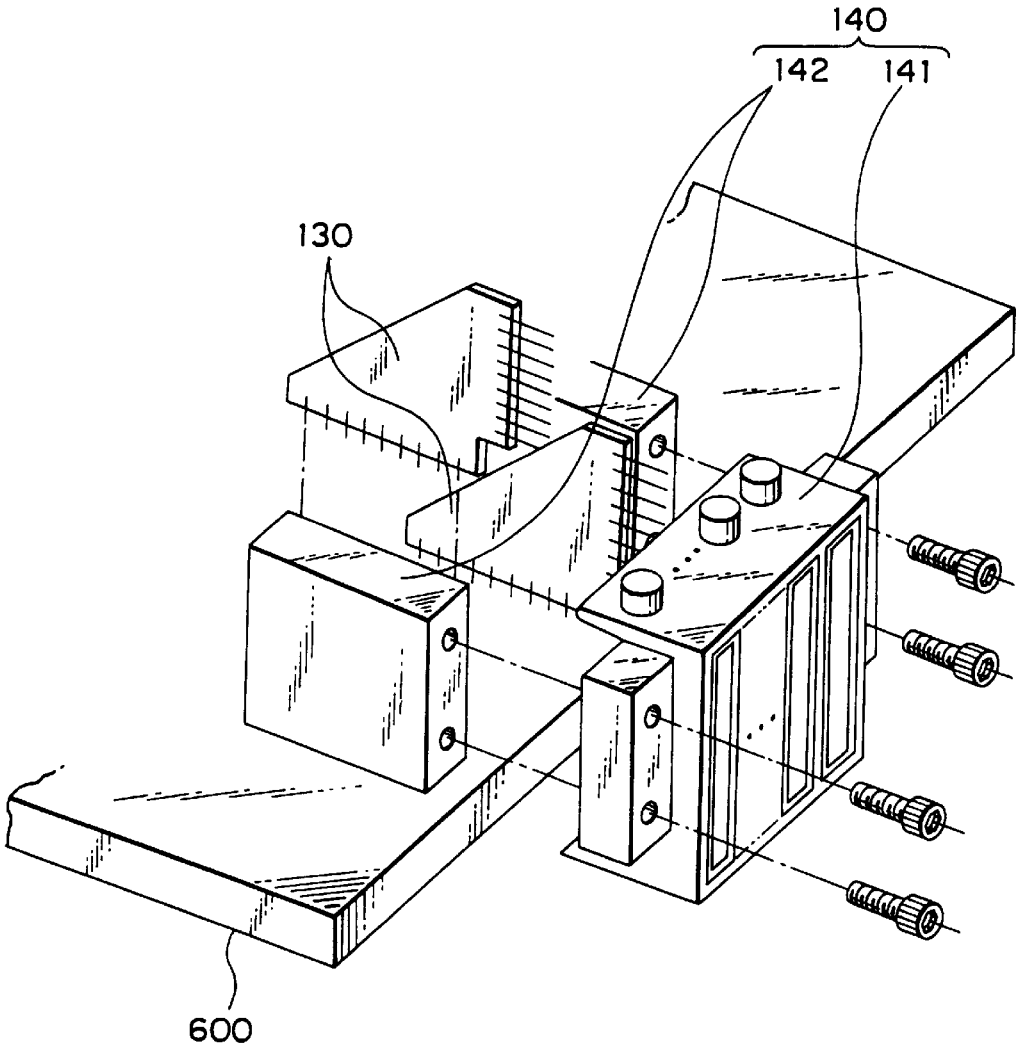
FIG. 5 is a disassembled perspective view illustrating a right-angle connector in a modification of the embodiment of FIGS. 2–4.

Referring to FIG. 5, the modification of the first right-angle connector is shown therein which has more than two printed circuit boards or connector boards 130. Accordingly, the second right-angle connector is also provided with more than two connector boards which are not shown.

The holding insulator 140 has a pair of blocks (collectively shown by 142) mounted and fixed to the first mother board 600 so as to left distance to each other. The connector boards 130 are mounted between the blocks 142 on the first mother board 600. The insulator 140 further has an alignment-cover 141 attached to the blocks 142 by the use of screws. The insulator 140 holds the connector boards 130 and guides the connectors 410 (shown in FIG. 4) being fitted thereinto.

On the other hand, the connector 410 of the cable connector 400 further comprises an insulator 412. The socket terminals (collectively shown by 411) are mounted and arranged in the insulator 412 so as to be electrically insulated to one another.

The insulator 140 serves to guide the insulator 412 to be fitted thereinto. After the insulator 412 has been fitted into the insulator 140, the insulator 412 is practically engaged or locked to the insulator 140 by the use of engaging means not shown.

The second right-angle connector 200 has the structure similar to the first right-angle connector 100 as described and illustrated above.

Figure 7:
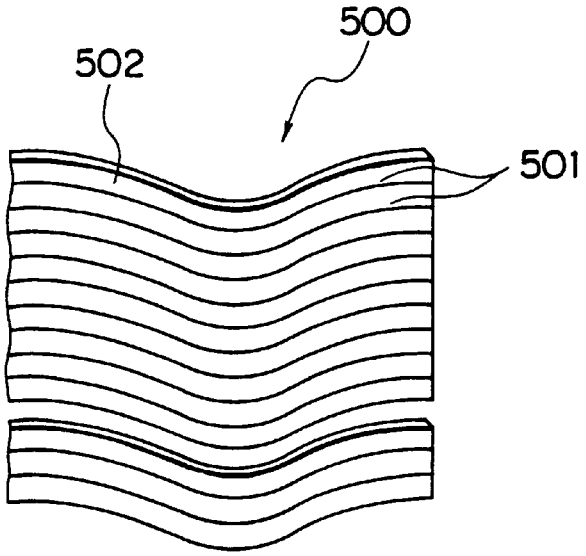
FIG. 7 is a perspective view illustrating a section of another example of the cable connector.

In the cable connector 400, a flexible printed cable 500 shown in FIG. 7 can be used in stead of the cable 430 shown in FIGS. 2 to 4. The flexible printed cable 500 comprises a ribbon-shaped flexible board 502 and print-patterns 501 printed on the flexible board 502. The print-patterns 501 serve instead of wires 431-1 to **431-*n* according to the first embodiment shown in FIGS. 2 and 4**, respectively.

Figure 8A:
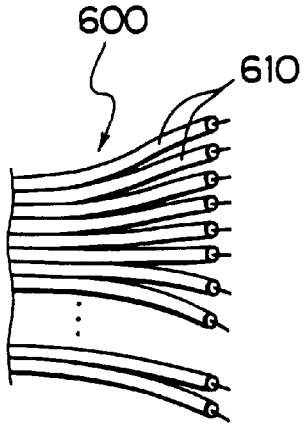
FIGS. 8A and 8B are perspective views illustrating a section of another example of the cable connector.
Figure 8B:
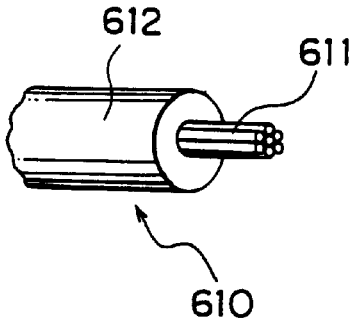

A bundle 600 of discrete cables 610 shown in FIGS. 8A and 8B can also be used in stead of the cable 430 shown in FIGS. 2 to 4. The discrete cables 610 comprise wire 611 and integument sleeve 612 covering the wire 611 therein, respectively. The wires 611 of the bundle 600 serve instead of wires 431-1 to **431-*n* according to the first embodiment shown in FIGS. 2 and 4**, respectively.

Figure 9A:
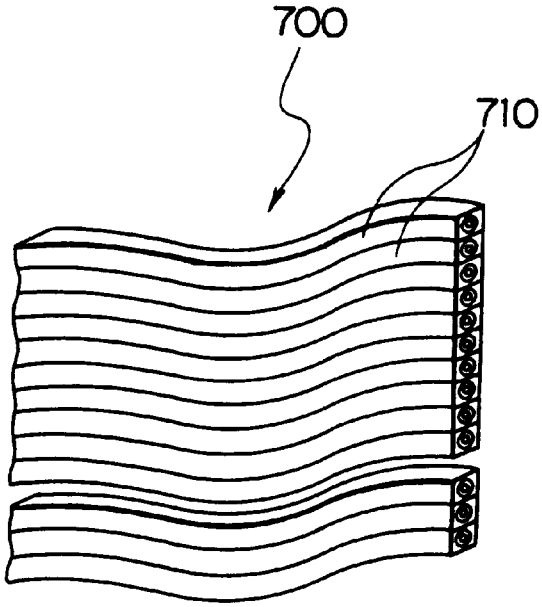
FIGS. 9A and 9B are perspective views illustrating a section of another example of the cable connector.
Figure 9B:
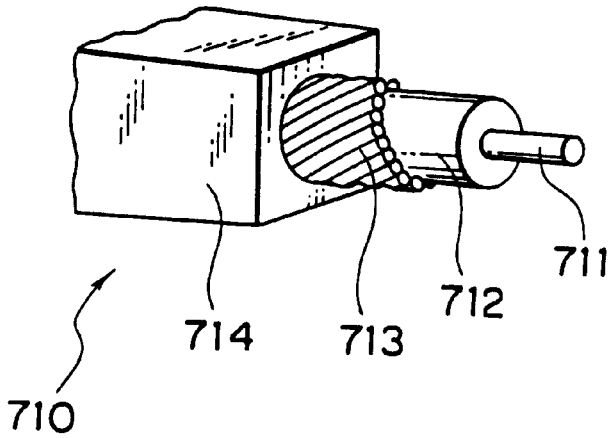

Further, a cable-group 700 of coaxial cables 710 shown in FIGS. 9A and 9B can also be used in stead of the cable 430 shown in FIGS. 2 to 4. The coaxial cables 710 comprise a core wire 711, a first integument sleeve 712 covering with the core wire 711, a shield sleeve 713 formed from a plurality of shield wires and covering the core wire 711 through the first integument sleeve 712 therein, and a second integument sleeve 714 covering the shield sleeve 713 therein.

The second integument sleeves 714 of the coaxial cables 711 are integrally formed into the cable-group 700 having a shape of ribbon.

The core wires 711 and the shield sleeves 713 serve instead of wires 431-1 to **431-*n* shown in FIGS. 2 and 4**, respectively.

Figure 10A:
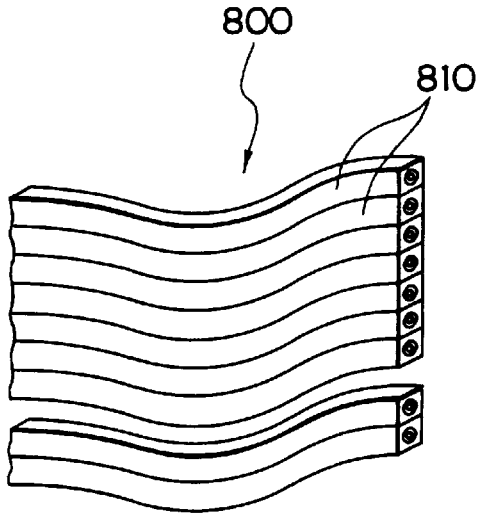
FIGS. 10A, 10B, and 10C are perspective views illustrating a section of a further example of the cable connector.
Figure 10B:
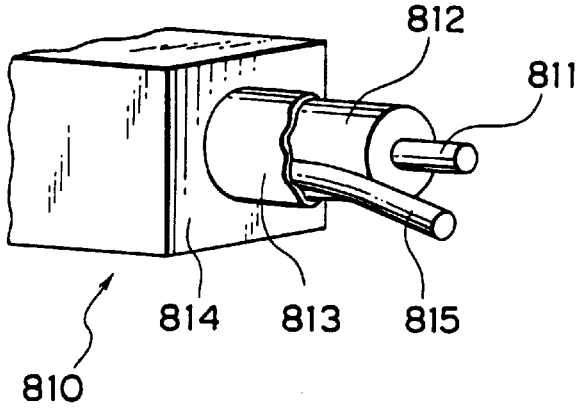

Moreover, a cable-group 800 of drained coaxial cables 810 shown in FIGS. 10A and 10B can also be used in stead of the cable 430 shown in FIGS. 2 to 4. The coaxial cables 810 comprise a core wire 811, a first integument sleeve 812 covering with the core wire 811, a shield sleeve 813 covering the core wire 811 through the first integument sleeve 812 therein, a drain wire 815 connected to the shield sleeve 813, and a second integument sleeve 814 covering the shield sleeve 813 and the drain wire 815 therein.

The second integument sleeves 814 of the drained coaxial cables 811 are integrally formed into the cable-group 800 having a shape of ribbon.

Figure 10C:
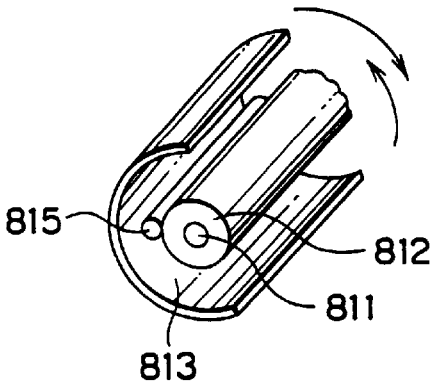

The shield sleeve 813 is made of a polyester film with a main surface thereof coated with aluminum. Referring to FIG. 10C, the shield sleeve 813 is wound round the first integument sleeve 812 and the drain wire 815 with the coated main surface inside like a cigarette so.

The core and the drain wires 811 and 815 serve instead of wires 431-1 to **431-*n* shown in FIGS. 2 and 4**, respectively.

Figure 11:
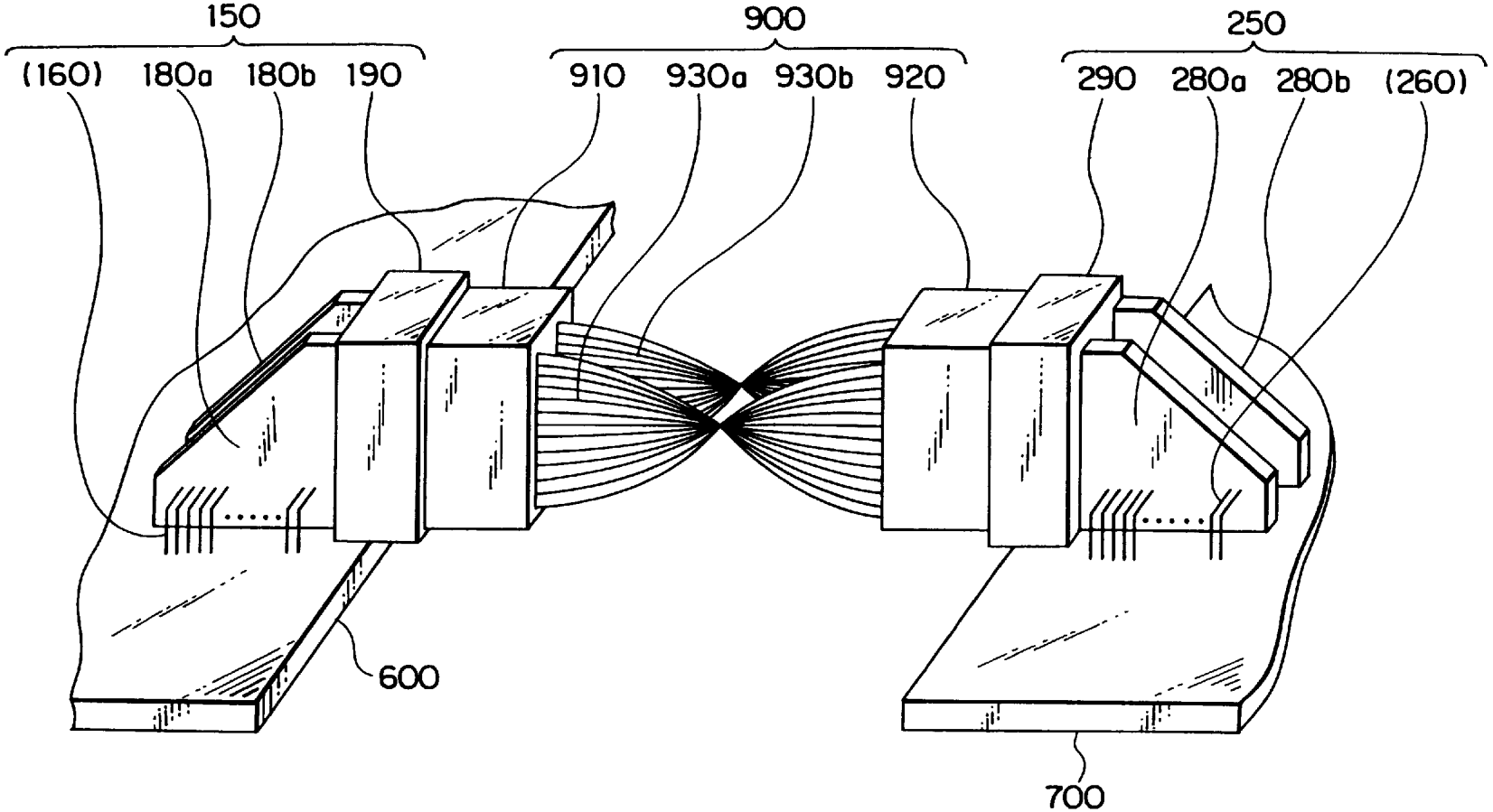
FIG. 11 is a perspective view showing a right-angle connector unit according to another embodiment of the present invention.

Referring to FIG. 11, a right-angle connector unit according to another embodiment of the present invention comprises first and second right-angle connectors 150 and 250 and cable connector 900 which are used in stead of the first and second right-angle connectors 100 and 200 and the cable connector 400 shown in FIG. 2, respectively.

The first right-angle connector 150 comprises first and second contact-lines (not shown). The first and the second contact-lines consist of at least one of the contacts instead of the primary contacts 103-1 to **103-*n* of the first right-angle connector 100 according to the first embodiment shown in FIGS. 2 and 4**.

More concretely, the first right-angle connector 150 comprises two first connector boards **180*a* and 180*b* corresponding to the first connector board 130 according to the first embodiment shown in FIG. 4, an insulator 190 corresponding to the insulator 140 according to the first embodiment shown in FIG. 4, and a plurality of terminals 160 corresponding to the terminals 110 according to the first embodiment shown in FIG. 4**.

Likewise, the second right-angle connector 250 comprises first and second contact-lines (not shown) corresponding to the secondary contacts 203-1 to **203-*n* of the second right-angle connector 200 according to the first embodiment shown in FIG. 2. The first and the second contact-lines consist of at least one of the contacts instead of the secondary contacts 203-1 to 203-*n***.

More concretely, the second right-angle connector 250 comprises two second connector boards **280*a* and 280*b* corresponding to the second connector board as the second right-angle connector 200 according to the first embodiment shown in FIG. 2, an insulator 290 corresponding to the insulator 240 of the second right-angle connector 200 according to the first embodiment shown in FIG. 2, and a plurality of terminals 260 corresponding to the terminals (not shown) of the second right-angle connector 200** according to the first embodiment.

Figure 12:
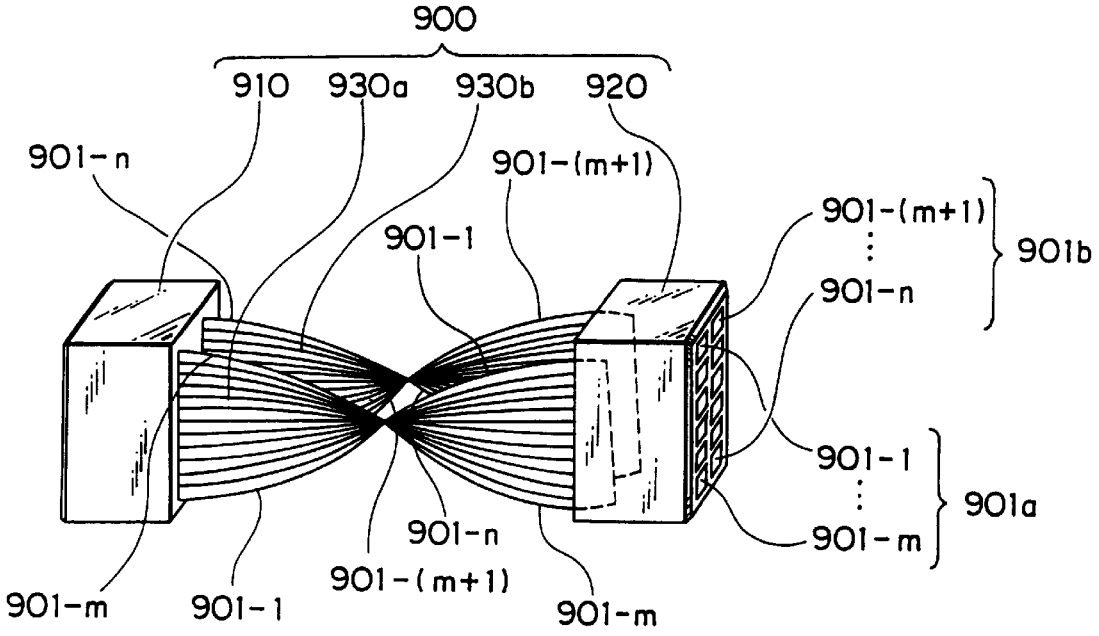
FIG. 12 is a perspective view showing a cable connector shown in FIG. 11.

Referring to FIG. 12, the cable connector 900 comprises first and second conductor-lines **901*a* and 901*b*. The first conductor-line 901*a* consists of conductors 901-1 to 901-*m* (where m is smaller than n) and is therefore corresponding to the conductor 401-1 to a conductor 401-*m* according to the first embodiment. The second conductor-line 901*b* consists of contact 901-(*m*+1) to 901-*n* and therefore is corresponding to a conductor 401-(*m*+1) to the conductor 401-*n*** according to the first embodiment.

Referring to FIGS. 11 and 12, the first conductor-line **901*a* of the cable connector 900 is connected between the first contact-line (not shown) of the first right-angle connector 150 and the first contact-line (not shown) of the second right-angle connector 250. Likewise, the second conductor-line 901*b* of the cable connector 900 is connected between the second contact-line (not shown) of the first right-angle connector 150 and the second contact-line (not shown) of the second right-angle connector 250**.

More concretely, the cable connector 900 comprises a first connector 910, a second connector 920, and first and second cables **930*a* and 930*b* corresponding to the first connector 410, the second connector 420, and the cable 430 according to the first embodiment shown in FIG. 3**, respectively.

Figure 13:
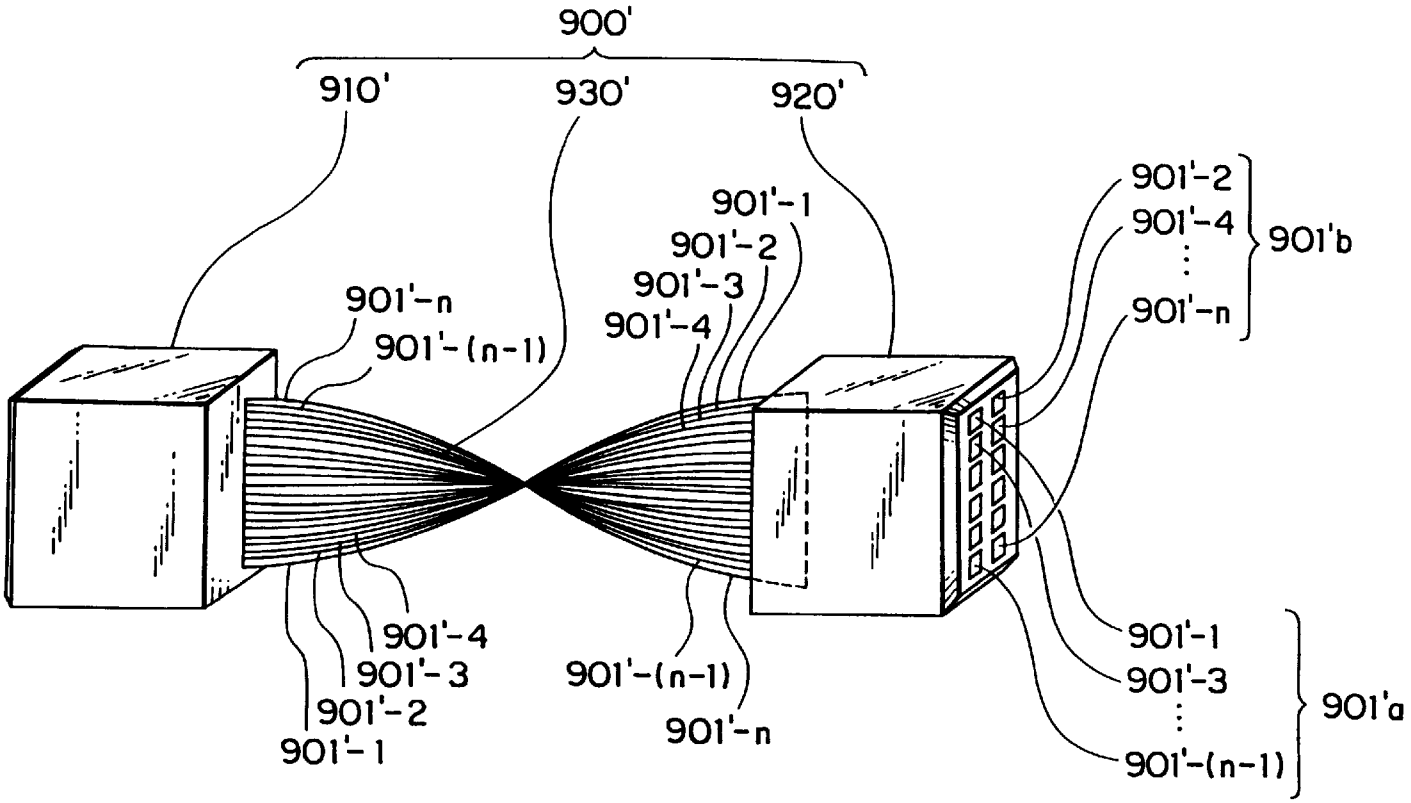
FIG. 13 is a perspective view showing another example of the cable connector shown in FIG. 12.

Referring to FIG. 13, another cable connector 900' is shown therein, which is used instead of the cable connector 900 shown in FIGS. 11 and 12.

The cable connector 900' comprises a first connector 910', a second connector 920', and a cable 930' corresponding to the first connector 910, the second connector 920, and the first and the second cables 930*a* and 930*b* shown in FIG. 12, respectively.

The first connector 910' comprises first contact-line (not shown) consisting of first, third, through (n−1)-th contacts equal to one another in length and second contact-line (not shown) consisting of second, fourth, through n-th contacts equal to one another in length. Likewise, the second connector 920' comprises first contact-line (not shown) consisting of first, third, through (n−1)-th contacts equal to one another in length and second contact-line (not shown) consisting of second, fourth, through n-th contacts equal to one another in length.

The cable 930' comprises first through n-th wires (not numbered) equal to one another in length. The first, the third, through the (n−1)-th wires of the first through the n-th wires are connected between the first, the third, through the (n−1)-th contacts of the first connector 910' and the (n−1)-th, through the third, the first contacts of the second connector 920', respectively. The second, the fourth, through the n-th wires of the first through the n-th wires are connected between the second, the fourth, through the n-th contacts of the first connector 910' and the n-th, through the fourth, the second contacts of the second connector 920', respectively;

The first, the third, through the (n−1)-th contacts of the first connector 910', the first, the third, through the (n−1)-th wires of the cable 930', and the (n−1)-th, through the third, the first contacts of the second connector 920' serve in cooperation with one another as conductors 901'-1, 901'-3, to **901'-(*n*−1) of the cable connector 900', respectively. The second, the fourth, through the n-th contacts of the first connector 910', the second, the fourth, through the n-th wires of the cable 930', and the n-th, through the fourth, the second contacts of the second connector 920' serve in cooperation with one another as conductors 901'-2, 901'-4, to 901'-*n* of the cable connector 900'**, respectively.

The conductors 901'-1, 901'-3, to **901'-(*n*−1) form a first conductor-group 901'*a* corresponding to the first conductor-line 901*a* as shown in FIG. 12. Likewise, the conductors 901'-2, 901'-4, to 901'-*n* form a second conductor-group 901'*b* corresponding to the second conductor-line 901*b* as shown in FIG. 12**.

In the embodiments described above, one part connected to another part may be practically and concretely connected by the use of soldering, press-soldering, or press-fitting. On the other hand, one part removably connected to another part may be practically and concretely connected by the use of press-fitting or the removably insertion of the ZIF-(Zero Insertion Force)-type known already.

While the present invention has thus far been described in conjunction with embodiments thereof, it will readily be possible for those skilled in the art to put the present invention into practice in various other manners. For example, a right-angle connector unit according to the present invention may comprise X contact-lines and X conductor-groups or X contact-lines and X conductor-lines (where X is an integer larger than 2).

What is claimed is:

1. A right-angle connector unit for making electrical and removable connections between first and second electrical devices, which comprises a first right-angle connector (100) connected to said first electrical device, a second right-angle connector (200) connected to said second electrical device, and a cable connector (400) having flexibility and being removably connected between said first and said second right-angle connectors, said first right-angle connector comprising a first base portion (101) facing a connection part of said first electrical device, a first vertical portion (102) extending substantially perpendicular to said first base portion, and first through n-th primary contacts (103-1 to **103-*n*) n being an integer but not smaller than 2, said contacts extending in parallel with one another between said first base and said first vertical portions, each of said first through said n-th primary contacts having one end and another end, respectively, said one end of said first through said n-th primary contacts being arranged in a first primary direction along said first base portion with spaces left between adjacent ones of said ends and being formed to be connected to said connection part of said first electrical device, the other end of each of said first through said n-th primary contacts being arranged in a second primary direction perpendicular to said first primary direction along said first vertical portion with spaces left between adjacent ones of said ends and being formed to be connected to one end of said cable connector, an i-th primary contact, i being an integer larger than 1 but not larger than n, of said first through said n-th primary contacts being longer than an (i−1)-th primary contact, said second right-angle connector comprising a second base portion (201) facing a connection part of said second electrical device, a second vertical portion (202) extending substantially perpendicular to said second base portion, and first through n-th secondary contacts (203-1 to 203-*n*) extending in parallel with one another between said second base and said second vertical portions, each of said first through said n-th secondary contacts having one end and the other end, one end of each of said first through said n-th secondary contacts being arranged in a first secondary direction along said second base portion with spaces left between adjacent ones and being formed to be connected to said connection part of said second electrical device, the other end of each of said first through said n-th secondary contacts being arranged in a second secondary direction perpendicular to said first secondary direction along said second vertical portion with spaces left between adjacent ones of said ends and being formed to be connected to one end of said cable connector, an i-th secondary contact of said first through said n-th secondary contacts being longer than an (i−1)-th secondary contact, said cable connector comprising first through n-th conductors (401-1 to 401-*n*)** equal to one another in length, wherein:

a first contact-combination formed by said first primary contact (103-1) and said n-th secondary contact **(203-*n*) through an n-th contact-combination formed by said n-th primary contact (103-*n*) and said first secondary contact (203-1)** are substantially equal in length to one another;

said first through said n-th conductors (401-1 to **401-*n*) connect said first through said n-th primary contacts (103-1 to 103-*n*) of said first right-angle connector (100) with said n-th through said first secondary contacts (203-*n* to 203-1) of said second right-angle connectors (200), respectively, a first signal path ($P_{AD}$) being formed by said first contact-combination (103-1 and 203-*n*) and said first conductor (431-1) through an n-th signal path ($P_{BC}$) formed by said n-th contact-combination (103-*n* and 203-1) and said n-th conductor (431-*n*)** being substantially equal to one another in length.

2. A right-angle connector unit as claimed in claim 1, wherein said first through said n-th primary contacts of said first right-angle connector are equal in length to said first through said n-th secondary contacts of said second right-angle connector, respectively.

3. A right-angle connector unit as claimed in claim 1, wherein said cable connector comprises a first connector removably connected to said first right-angle connector, a second connector removably connected to said second right-angle connector, and a cable connected between said first and said second connectors;

said first and said second connectors comprising first through n-th contacts equal to one another in length, respectively;

said cable comprising first through n-th wires equal to one another in length;

said first through said n-th wires being connected between said first through said n-th contacts of said first connector and said n-th through said first contacts of said second connector, respectively;

said first through said n-th contacts of said first connector, said first through said n-th wires, and said n-th through said first contacts of said second connector serving in cooperation with one another as said first through said n-th conductors, respectively.

4. A right-angle connector unit as claimed in claim 3, wherein said cable connector comprises a flat ribbon cable serving as said cable, said flat ribbon cable comprising an integument sleeve covering with said first through said n-th wires.

5. A right-angle connector unit as claimed in claim 3, wherein said cable connector comprises a flexible printed cable serving as said cable, said flexible printed cable comprising a ribbon-shaped flexible board and a plurality of print-patterns printed on said flexible board;

the print-patterns serving as said first through said n-th wires.

6. A right-angle connector unit as claimed in claim 3, wherein said cable connector comprises a bundle of discrete cables serving as said cable, each of said discrete cables comprising an integument sleeve covering with one wire selected from said first through said n-th wires, respectively.

7. A right-angle connector unit as claimed in claim 3, wherein said cable connector comprises a plurality of coaxial cables serving as said cable, each of said coaxial cables comprising a core wire, a first integument sleeve covering with said core wire, a shield sleeve covering with said core wire through said first integument sleeve, and a second integument sleeve covering with said shield sleeve;

said core wire and said shield sleeve serving as one wire of said first through said n-th wires, respectively.

8. A right-angle connector unit as claimed in claim 7, wherein the second integument sleeves of said coaxial cables are integrally formed.

9. A right-angle connector unit as claimed in claim 3, wherein said cable connector comprises a plurality of drained coaxial cables serving as said cable, each of said drained coaxial cables comprising a core wire, a first integument sleeve covering with said core wire, a shield sleeve covering with said core wire through said first integument sleeve, a drain wire connected to said shield sleeve, and a second integument sleeve covering with said shield and said drain wires;

said core wire and said drain wire serving as one wire of said first through said n-th wires, respectively.

10. A right-angle connector unit as claimed in claim 9, wherein the first integument sleeves of said drained coaxial cables are integrally formed.

11. A right-angle connector unit for electrical and removable connections between first and second electrical devices, which comprises a first right-angle connector (150) connected to said first electrical device, a second right-angle connector (250) connected to said second electrical device, and a cable connector (900) having flexibility and being removably connected between said first and said second right-angle connectors, said first right-angle connector comprising a first base portion facing a connection part of said first electrical device, a first vertical portion extending substantially perpendicular to said first base portion, and first through n-th primary contacts, n being an integer which is at least 2, said contacts extending in parallel with one another between said first base and said first vertical portions, each of said first through said n-th primary contacts having one end and another end, respectively, one end of said first through said n-th primary contacts being arranged in a first primary direction along said first base portion with spaces left between adjacent ones and being formed to be connected to said connection part of said first electrical device, the other end of said first through said n-th primary contacts being arranged in a second primary direction perpendicular to said first primary direction along said first vertical portion with spaces left between adjacent ones and being formed to be connected to one end of said cable connector, an i-th primary contact, i being an integer larger than 1 but not larger than n, of said first through said n-th primary contacts being longer than an (i−1)-th primary contact, said second right-angle connector comprising a second base portion facing a connection part of said second electrical device, a second vertical portion extending substantially perpendicular to said second base portion, and first through n-th secondary contacts extending in parallel with one another between said second base and said second vertical portions, each of said first through said n-th secondary contacts having one end and another end, said one end of said first through said n-th secondary contacts being arranged in a first secondary direction along said second base portion with spaces left between adjacent ones of said ends and being formed to be connected to said connection part of said second electrical device, the other end of each of said first through said n-th secondary contacts being arranged in a second secondary direction perpendicular to said first secondary direction along said second vertical portion with spaces left between adjacent ones of said ends and being formed to be connected to one end of said cable connector, an i-th secondary contact of said first through said n-th secondary contacts being longer than an (i−1)-th secondary contact, said cable connector comprising first through n-th conductors (901-1 to **901-*n*) equal to one another in length, wherein, said first through said n-th primary contacts of said first right-angle connector (150)** are divided and arrayed into first primary contact-line consisting of first through m-th contacts, m being smaller than n and at least 1, and second primary contact-line consisting of (m+1)-th through n-th contacts;

said first through said n-th secondary contacts of said second right-angle connector (250) being divided and arrayed into first secondary contact-line consisting of first through m-th contacts and second secondary contact-line consisting of (m+1)-th through n-th contacts;

said first through said n-th conductors (901-1 to **901-*n*) of said cable connector (900) being divided and arrayed into first cable-line consisting of first through m-th conductors (901-1 to 901-*m*) and second cable-line consisting of (m+1)-th through n-th conductors (901-(*m*+1) to 901-*n*)**;

a first contact-combination formed by said first primary contact and said m-th secondary contact through an m-th contact-combination formed by said m-th primary contact and said first secondary contact being substantially equal in length to one another;

an (m+1)-th contact-combination formed by said (m+1)-th primary contact and said n-th secondary contact through an n-th contact-combination formed by said n-th primary contact and said (m+1)-th secondary contact being substantially equal in length to one another;

said first through said m-th conductors (901-1 to **901-*m***) being connected between said first through said m-th primary contacts of said first right-angle connector and said m-th through said first secondary contacts of said second right-angle connector, respectively;

said (m+1)-th through said n-th conductors (**901-(*m*+1) to 901-*n***) being connected between said (m+1)-th through said n-th primary contacts of said first right-angle connector and said n-th through said (m+1)-th secondary contacts of said second right-angle connector, respectively;

a first signal path being formed by said first contact-combination and said first conductor through an m-th signal path formed by said m-th contact-combination and said m-th conductor being substantially equal to one another in length:

an (m+1)-th signal path being formed by said (m+1)-th contact-combination and said (m−1)-th conductor through an n-th signal path formed by said n-th contact-combination and said n-th conductor being substantially equal to one another in length.

12. A right-angle connector unit as claimed in claim 11, wherein said first through said n-th primary contacts of said first right-angle connector are divided and arrayed into a first primary contact-line comprising first, third, through (n−1)-th contacts and second primary contact-line comprising second, fourth, through n-th contacts;

said first through said n-th secondary contacts of said second right-angle connector being divided and arrayed into a first secondary contact-line comprising first, third, through (n−1)-th contacts and second secondary contact-line comprising second, fourth, through n-th contacts;

said cable connector comprising a first connector removably connected to said first right-angle connector, a second connector removably connected to said second right-angle connector, and a cable connected between said first and said second connectors;

said first connector comprising a first primary contact-line comprising first, third, through (n−1)-th contacts having lengths equal to one another and second primary contact-line comprising second, fourth, through n-th contacts having lengths equal to one another;

said second connector comprising first secondary contact-line comprising first, third, through (n−1)-th contacts having lengths equal to one another and second secondary contact-line comprising second, fourth, through n-th contacts having lengths equal to one another;

said cable comprising first through n-th wires having lengths equal to one another;

the first, the third, through the (n−1)-th wires of said first through said n-th wires being connected between said first, said third, through said (n−1)-th contacts of said first connector and said (n−1)-th through said third, said first contacts of said second connector, respectively;

the second, the fourth, through the n-th wires of said first through said n-th wires being connected between said second, said fourth, through said n-th contacts of said first connector and said n-th, through said fourth, said second contacts of said second connector, respectively;

said first, said third, through said (n−1)-th contacts of said first connector, said first, said third, through said (n−1)-th wires, and said (n−1)-th, through said third, said first contacts of said second connector serving in cooperation with one another as the first, the third, through the (n−1)-th conductors of said first through said n-th conductors, respectively;

said second, said fourth, through said n-th contacts of said first connector, said second, said fourth, through said n-th wires, and said n-th, through said fourth, said second contacts of said second connector serving in cooperation with one another as the second, the fourth, through the n-th conductors of said first through said n-th conductors, respectively.

13. A right-angle connector unit as claimed in claim 11, wherein said cable comprises a plurality of cable-lines connected between the end lines of said first connector and the end lines of said second connector, respectively.

14. A right-angle connector unit as claimed in claim 11, wherein said first through said n-th contacts of at least one of said first and said second right-angle connector comprises a first terminal arranged in at least one of said first and said second base portion, a second terminal arranged in at least one of said first and said second vertical portion, and a print-pattern printed on a circuit board and connected between said first and second terminals, respectively;

the circuit boards of said at least one of said first and said second right-angle connector being integrally formed and arranged perpendicularly to said connection part of said at least one of said first and said second electrical device;

said first terminal having an L-shape and being provided with first and second lines angled with respect to each other so as to form a nearly right-angle therebetween, said first line being connected to said connection part of each of said at least one of said first and said second electrical device, said second line being connected to said print-pattern;

said second terminal having an L-shape provided with first and second lines angled with respect to each other to form a nearly right-angle therebetween, said first line being removably connected to said cable connector, said second line being connected to said print-pattern.

15. A right-angle connector unit as claimed in claim 11, wherein:

said cable connector (900) comprises a first connector (910) removably connected to said first right-angle connector (150), a second connector (920) removably connected to said second right-angle connector (250), and first and second cables (**930*a* and 930*b*) connected between said first and said second connectors (910 and 920**);

said first and said second connectors (910 and 920) comprising first through m-th contacts having lengths equal to one another, respectively;

said first and said second connectors (910 and 920) further comprising (m+1)-th through n-th contacts having lengths equal to one another, respectively;

said first cable (**930*a***) comprising first through m-th wires equal to one another in length;

said second cable (**930*b***) comprising (m+1)-th through n-th wires having lengths equal to one another;

said first through said m-th wires being connected between said first through said m-th contacts of said first connector (910) and said m-th through said first contacts of said second connector (920), respectively:

said (m+1)-th through said n-th wires being connected between said (m−1)-th through said n-th contacts of said first connector (910) and said n-th through said (m+1)th contacts of said second connector (920), respectively;

said first through said m-th contacts of said first connector (910), said first through said m-th wires, and said m-th through said first contacts of said second connector (920) serving in cooperation with one another as said first through said m-th conductors (901-1 to **901-*m***), respectively;

said (m+1)-th through said n-th contacts of said first connector (910), said (m+1)-th through said n-th wires, and said n-th through said (m+1)-th contacts of said second connector (920) in cooperation with one another as said (m+1)-th through said n-th conductors (**901-(*m*+1) to 901-*n***), respectively;

said first cable (**930*a*) being twisted along a longitudinal direction thereof so that said first through said m-th wires placed at one end of said first cable (930*a*) and said first through said m-th wires placed at the other end of said first cable (930*a***) are turned over each other, respectively;

said second cable (**930*b*) being twisted along a longitudinal direction thereof so that said (m+1)-th through said n-th wires placed at one end of said second cable (930*b*) and said (m+1)-th through said n-th wires placed at the other end of said second cable (930*b***) are inverted relative to each other, respectively.

* * * * *